US011773640B2

(12) United States Patent
Fontijn et al.

(10) Patent No.: US 11,773,640 B2
(45) Date of Patent: Oct. 3, 2023

(54) SLIMLINE SYSTEM

(71) Applicant: GOLDBRECHT LLC, Culver City, CA (US)

(72) Inventors: Marcel Fontijn, Culver City, CA (US); Joshua Steven Ray, Los Angeles, CA (US)

(73) Assignee: GOLDBRECHT LLC, Culver City, CA (US)

( * ) Notice: Subject to any disclaimer, the term of this patent is extended or adjusted under 35 U.S.C. 154(b) by 77 days.

(21) Appl. No.: 16/592,983

(22) Filed: Oct. 4, 2019

(65) Prior Publication Data

US 2020/0109591 A1 Apr. 9, 2020

Related U.S. Application Data

(60) Provisional application No. 62/741,089, filed on Oct. 4, 2018.

(51) Int. Cl.
*E06B 3/26* (2006.01)
*E06B 3/48* (2006.01)

(52) U.S. Cl.
CPC . *E06B 3/26* (2013.01); *E06B 3/48* (2013.01)

(58) Field of Classification Search
CPC ... E06B 3/469; E06B 3/26; E06B 3/48; E06B 3/2605; E06B 3/5454; E06B 3/5054; E06B 3/5072; E06B 3/5063
USPC ..... 49/61–63, 125
See application file for complete search history.

(56) References Cited

U.S. PATENT DOCUMENTS 2,120,359 A * 6/1938 Hartmann ..... E06B 3/44 49/164
3,065,507 A * 11/1962 Cloutier ..... E06B 3/44 49/458
3,117,657 A * 1/1964 Bruno ..... A47K 3/34 49/425
3,295,587 A * 1/1967 Horgan, Jr. ..... E06B 3/4618 160/91
4,333,272 A * 6/1982 Eastman ..... E06B 3/4609 49/505
4,333,283 A * 6/1982 Ebata ..... E06B 3/2605 49/504
4,398,372 A * 8/1983 Anderson ..... E05B 65/08 49/163
4,633,616 A * 1/1987 Giguere ..... E06B 3/4618 49/419

(Continued)

FOREIGN PATENT DOCUMENTS

DE 102009022827 A1 * 12/2010 ..... E06B 5/167
EP 3228796 A1 * 10/2017 ..... E05D 15/0686

(Continued)

*Primary Examiner* — Marcus Menezes
(74) *Attorney, Agent, or Firm* — Sughrue Mion, PLLC

(57) ABSTRACT

Provided is a window system including a first window that extends in a first direction, and that partially overlaps a second window in the first direction. The second window extends in the first direction, and is offset from the first window in a second direction that is orthogonal to the first direction. The window system includes a connector that is configured to connect the first window and the second window, and that is disposed in an area between the first window and the second window in the second direction and where the first window partially overlaps the second window in the first direction.

3 Claims, 6 Drawing Sheets

(56) References Cited

U.S. PATENT DOCUMENTS 5,014,466 A * 5/1991 Winner ..... E06B 3/5454 52/786.13
5,274,955 A * 1/1994 Dallaire ..... E06B 3/44 49/406
5,555,684 A * 9/1996 Galowitz ..... E06B 1/342 52/204.5
5,678,366 A * 10/1997 Nambo ..... E06B 3/4609 49/467
5,737,874 A * 4/1998 Sipos ..... E06B 9/02 49/63
5,943,822 A * 8/1999 Slocomb ..... E06B 3/9608 49/176
6,276,092 B1 * 8/2001 Neo ..... E05D 15/0604 49/176
6,481,159 B2 * 11/2002 Diston ..... E06B 3/2605 49/142
7,716,875 B2 * 5/2010 Langner ..... E06B 3/44 49/458
8,931,537 B2 * 1/2015 Morton ..... E05F 11/16 49/73.1
9,175,508 B1 * 11/2015 Steele ..... E06B 3/72
9,441,405 B2 * 9/2016 Chubb ..... E05D 15/0686
9,856,691 B2 * 1/2018 Nielsen ..... E06B 7/2305
10,900,273 B1 * 1/2021 Salvoni ..... E06B 3/9642
11,193,318 B2 * 12/2021 Kellum ..... E05D 13/04
2005/0166494 A1 * 8/2005 Guhl ..... E06B 3/5454 52/204.1
2007/0175121 A1 * 8/2007 Speyer ..... E06B 3/46 52/207
2014/0150343 A1 * 6/2014 Dochtermann, III ..... E06B 9/06 49/57
2015/0052816 A1 * 2/2015 Chen ..... E05D 15/58 49/177
2016/0123053 A1 * 5/2016 Martin ..... E06B 3/34 49/504
2017/0268274 A1 * 9/2017 Hoover ..... E06B 3/341
2018/0216397 A1 * 8/2018 Chen ..... E06B 9/52

FOREIGN PATENT DOCUMENTS

FR 2587403 A1 * 3/1987 ..... E06B 3/50
FR 2655085 A1 * 5/1991 ..... E06B 3/5821
FR 2718784 A1 * 10/1995 ..... E06B 3/469

* cited by examiner

SLIMLINE SYSTEM

CROSS-REFERENCE TO RELATED APPLICATION(S)

This application claims is based on and claims priority under 35 U.S.C. § 119 to U.S. Application No. 62/741,089, filed on Oct. 4, 2018, in the U.S. Patent & Trademark Office, the disclosure of which is incorporated by reference herein in its entirety.

BACKGROUND

1. Field

The present disclosure relates to a window system that provides an improved sightline between adjacent window panels of the window system.

2. Description of Related Art

A window system typically includes adjacent window panels that are supported by hardware components. Typically, the adjacent window panels are disposed in a same plane. That is, outer surfaces and inner surfaces of adjacent window panels are typically flush. Further, various hardware components are typically provided between the adjacent window panels. Accordingly, and in this way, the hardware components obstruct a user's view, and thereby cause unsightliness.

SUMMARY

A window system may include a first window including: a first internal window surface that extends in a first direction; a first external window surface that extends in the first direction, and that is disposed behind the first internal window surface in a second direction that is orthogonal to the first direction; and a first side window surface that extends between the first internal window surface and the first external window surface in the second direction. The window system may include a second window including: a second internal window surface that extends in the first direction, and that is disposed behind the first external window surface of the first window in the second direction; a second external window surface that extends in the first direction, and that is disposed behind the second internal window surface in the second direction; and a second side window surface that extends between the second internal window surface and the second external window surface in the second direction. The window system may include a first frame, that is configured to support the first window, including: a first internal frame surface that extends in the first direction, and that is configured to support the first internal window surface of the first window; a first external frame surface that extends in the first direction, and that is configured to support the first external window surface of the first window; a first side frame surface that extends between the first internal frame surface and the first external frame surface, and that is configured to support the first side window surface of the first window; and a first frame connection component that extends from the first external frame surface in the second direction towards a second internal frame surface of a second frame, and that is configured to connect to the second internal frame surface of the second frame. The window system may include a second frame, that is configured to support the second window, including: the second internal frame surface that extends in the first direction, and that is configured to support the second internal window surface of the second window; a second external frame surface that extends in the first direction, and that is configured to support the second external window surface of the second window; a second side frame surface that extends between the second internal frame surface and the second external frame surface in the second direction, and that is configured to support the second side window surface of the second window; and a second frame connection component that extends from the second internal frame surface in the second direction towards the first external frame surface of the first frame, and that is configured to connect to the first external frame surface of the first frame.

BRIEF DESCRIPTION OF THE DRAWINGS

These and/or other aspects will become apparent and more readily appreciated from the following description of exemplary embodiments, taken in conjunction with the accompanying drawings of which.

DETAILED DESCRIPTION

The following detailed description of example implementations refers to the accompanying drawings. The same reference numbers in different drawings may identify the same or similar elements.

Figure 1:
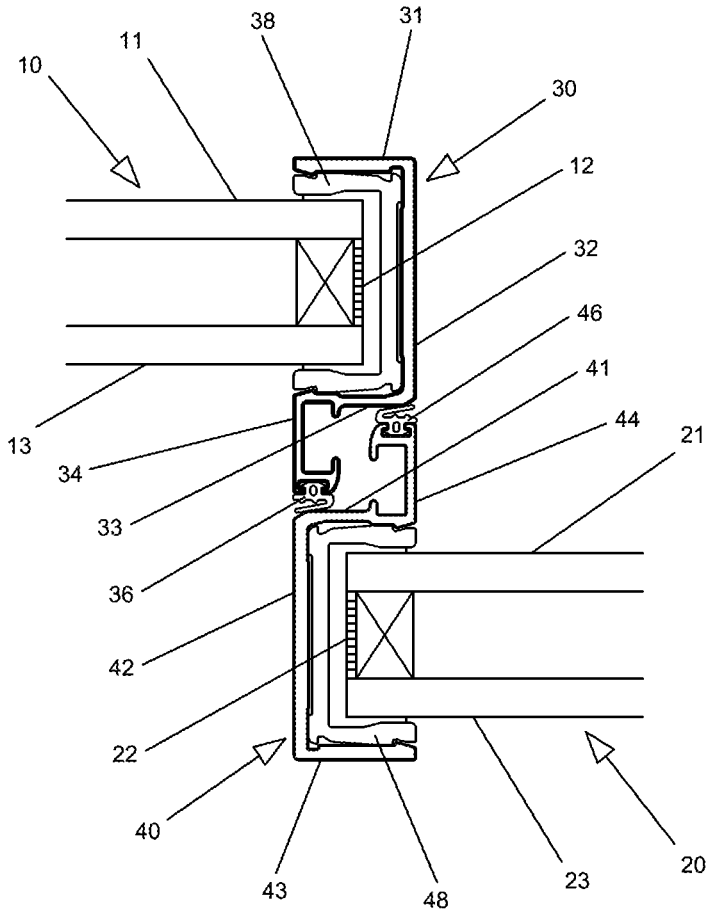
FIG. 1 is a diagram of a window system according to an embodiment.

FIG. 1 is a diagram of a window system according to an embodiment. As shown in FIG. 1, a window system 1 may include a first window 10, a second window 20, a first frame 30, and a second frame 40. The window system 1 may include a connector that is comprised of the first frame 30 and the second frame 40. Alternatively, the window system 1 may include a connector that is comprised of an integrated frame. That is, the first frame 30 and the second frame 40 may be integrated as a single component. Referring to FIG. 1, and for explanatory purposes, a direction that extends towards a left side and a right side of the page may correspond to a first direction (e.g., a horizontal direction). Further, a direction that extends towards a top and a bottom of the page may correspond to a second direction (e.g., a second direction) that is orthogonal to the first direction. Further still, a direction that extends into and out of the page may correspond to a third direction (e.g., a vertical direction). Accordingly, FIG. 1 is a bird's eye view of the window system 1 in relation to the vertical direction.

The first window 10 may include a first internal window surface 11 that extends in the first direction. Further, the first window 10 may include a first external window surface 13 that extends in the first direction, and that is disposed behind the first internal window surface 11 in the second direction. Further still, the first window 10 may include a first side window surface 12 that extends between the first internal window surface 11 and the first external window surface 13 in a second direction that is orthogonal to the first direction.

The second window 20 may include a second internal window surface 21 that extends in the first direction, and that is disposed behind the first external window surface 13 of the first window 10 in the second direction. In other words, the second window 20 may be offset from first window 10 in the second direction. Put yet another way, the first internal window surface 11 and the second internal window surface 21 may be disposed in offset parallel planes.

Further, the second window 20 may include a second external window surface 23 that extends in the first direction, and that is disposed behind the second internal window surface 21 in the second direction. Further still, the second window 20 may include a second side window surface 22 that extends between the second internal window surface 21 and the second external window surface 23 in the second direction.

The first frame 30 may be configured to support the first window 10. The first frame 30 may include a first internal frame surface 31 that extends in the first direction, and that is configured to support the first internal window surface 11 of the first window 10. For example, as shown, the first internal frame surface 31 may overlap a portion of the first internal window surface 11, and may support the first internal window surface 11 in the area formed by the overlap.

Further, the first frame 30 may include a first external frame surface 33 that extends in the first direction, and that is configured to support the first external window surface 13 of the first window 10. For example, as shown, the first external frame surface 33 may overlap a portion of the first external window surface 13, and may support the first external window surface 13 in the area formed by the overlap.

Further still, the first frame 30 may include a first side frame surface 32 that extends between the first internal frame surface 31 and the first external frame surface 33, and that is configured to support the first side window surface 12 of the first window 10.

Further still, the first frame 30 may include a first frame connection component 34 that extends from the first external frame surface 33 in the second direction towards a second internal frame surface 41 of a second frame 40, and that is configured to connect to the second internal frame surface 41 of the second frame 40. For example, as shown, the first frame connection component 34 may include a first connection mechanism 36 that is configured to connect to the second internal frame surface 41 of the second frame 40. The first connection mechanism 36 may include a tab, a detent, a lock, a hinge, a gasket, a brush, and/or the like.

Further still, the first frame 30 may include a first window connection mechanism 38 that is configured to connect the first frame 30 to the first window 10. For example, the first window connection mechanism 38 may include an adhesive, a plastic, a rubber, a foam, and/or the like, that connects the first frame 30 and the first window 10.

The second frame 40 may be configured to support the second window 20. The second frame 40 may include a second internal frame surface 41 that extends in the first direction, and that is configured to support the second internal window surface 21 of the second window 20. For example, as shown, the second internal frame surface 41 may overlap a portion of the second internal window surface 21 of the second window 20, and may support the second internal window surface 21 in the area formed by the overlap.

Further, the second frame 40 may include a second external frame surface 43 that extends in the first direction, and that is configured to support the second external window surface 23 of the second window 20. For example, as shown, the second external frame surface 43 may overlap a portion of the second external window surface 23 of the second window 20, and may support the second external window surface 23 in the area formed by the overlap.

Further still, the second frame 40 may include a second side frame surface 42 that extends between the second internal frame surface 41 and the second external frame surface 43 in the second direction, and that is configured to support the second side window surface 22 of the second window 20.

Further still, the second frame 40 may include a second frame connection component 44 that extends from the second internal frame surface 41 in the second direction towards the first external frame surface 33 of the first frame 30, and that is configured to connect to the first external frame surface 33 of the first frame 30. For example, as shown, the second frame connection component 44 may include a second connection mechanism 46 that is configured to connect to the first internal frame surface 31 of the first frame 30. The second connection mechanism 46 may include a tab, a detent, a lock, a hinge, a gasket, a brush, and/or the like.

Further still, the second frame 40 may include a second window connection mechanism 48 that is configured to connect the second frame 40 to the second window 20. For example, the second window connection mechanism 48 may include an adhesive, a plastic, a rubber, a foam, and/or the like, that connects the second frame 40 and the second window 20.

As shown in FIG. 1, a width of the first frame 30 may be the same as a width of the second frame 40. Further, and as shown, the widths of the first frame 30 and the second frame 40 may overlap in the first direction. That is, the first frame 30 and the second frame 40 may entirely overlap in the first direction. Further still, and as shown, a portion of the first window 10 and a portion of the second window 20 may overlap in the first direction.

Accordingly, in this way, the window system 1 includes an improved sightline based on a reduction in the amount of hardware disposed between adjacent windows. In other words, the hardware (e.g., the first frame 30 and the second frame 40) is disposed between the first window 10 and the second window 20 in the second direction instead of in the first direction. Accordingly, the visible amount of hardware between adjacent windows is reduced as compared to window systems that employ hardware between adjacent windows in the first direction.

Figure 2:
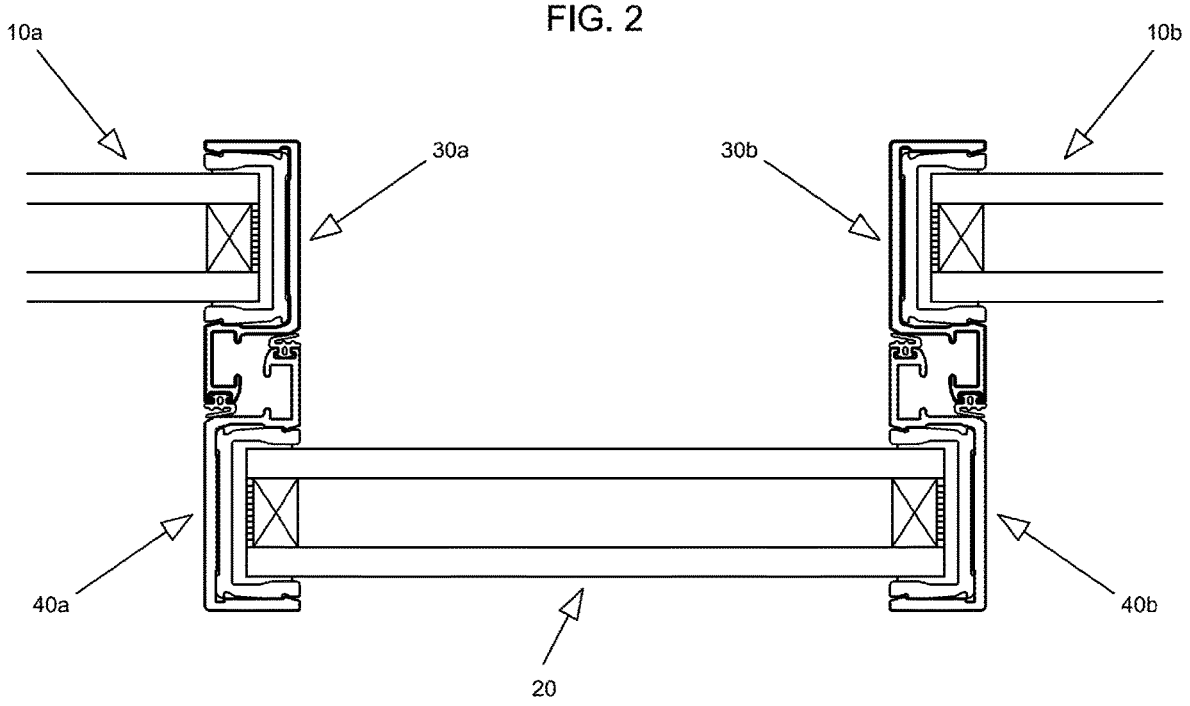
FIG. 2 is a diagram of a window system in a closed state according to an embodiment.

FIG. 2 is a diagram of a window system in a closed state according to an embodiment. As shown in FIG. 2, a window system 1 may include a first window 10*a*, a first window 10*b*, a second window 20, a first frame 30*a*, a first frame 30*b*, a second frame 40*a*, and a second frame 40*b*.

As shown, the first frame 30*a* may support the first window 10*a*, and may connect to the second frame 40*a* that supports a left side of the second window 20. Further, the first frame 30*b* may support the first window 10*b*, and may connect to the second frame 40*b* that supports a right side of the second window 20.

The window system 1 is shown in FIG. 2 as being in a closed state. In the closed state, the respective internal and external surfaces of the first window 10*a*, the first window 10*b*, and the second window 20 are disposed in a parallel manner. Further, in the closed state, the first frame 30*a* is connected to the second frame 40*a*. Further still, in the closed state, the first frame 30*b* is connected to the second frame 40*b*.

Figure 3:
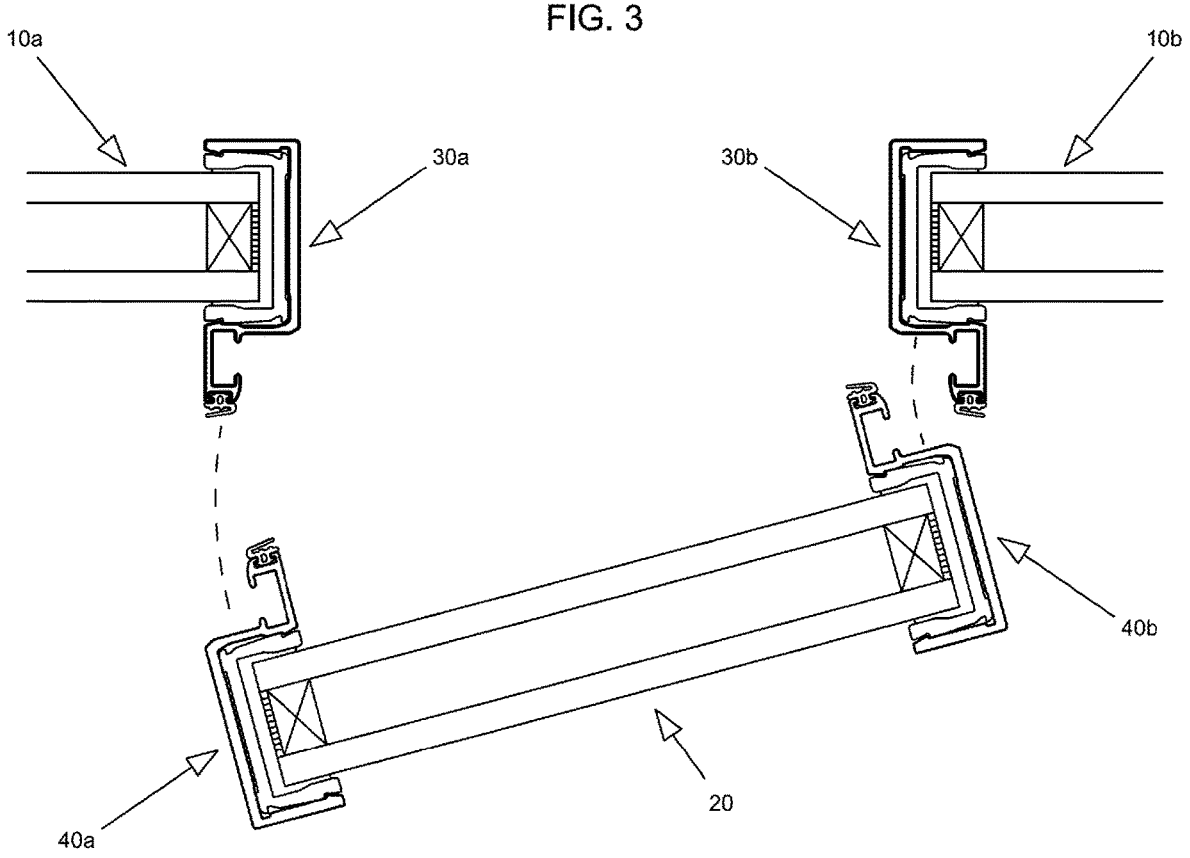
FIG. 3 is a diagram of a window system in an opened state according to an embodiment.

FIG. 3 is a diagram of a window system in an opened state according to an embodiment. As shown in FIG. 3, the window system 1 may include the first window 10*a*, the first window 10*b*, the second window 20, the first frame 30*a*, the first frame 30*b*, the second frame 40*a*, and the second frame 40*b*.

The window system 1 is shown in FIG. 3 as being in an opened state. In the opened state, the respective internal and external window surfaces of the first window 10*a* and the first window 10*b* may be parallel and planar. However, in the opened state, the internal surface and the external surface of the second window 20 may be non-parallel to the internal and external surfaces of the first window 10*a* and the first window 10*b*. That is, as shown, the second window 20 may be configured to move in relation to the first window 10*a* and the first window 10*b*.

Further, in the opened state, the first frame 30*a* may be disconnected from the second frame 40*a*. Further still, in the opened state, the first frame 30*b* may be disconnected from the second frame 40*b*. In this way, the second window 20 may move in relation to the first window 10*a* and the first window 10*b* based on the various frames being disconnected.

FIG. 3 depicts the second window 20 as being moved in the second and first directions with respect to the first window 10*a* and the first window 10*b*. However, in other embodiments, the second window 20 may move in the second, horizontal, and/or vertical direction with respect to the first window 10*a* and the first window 10*b*.

Further still, the window system 1 may include any type of movement mechanism that permits and/or facilitates movement of the second window 20 with respect to the first window 10*a* and the first window 10*b*.

Figure 4:
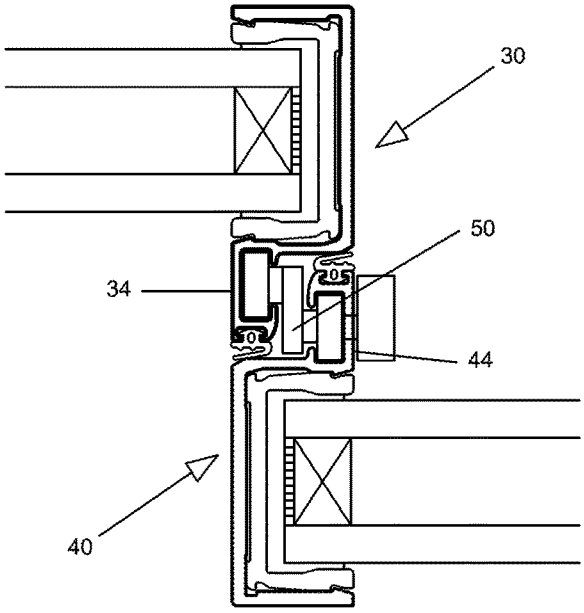
FIG. 4 is a diagram of a window system including an integrated lock according to an embodiment.

FIG. 4 is a diagram of a window system including an integrated lock according to an embodiment. As shown in FIG. 4, the window system 1 may include an integrated lock 50 that is configured to lock and unlock the first frame 30 and the second frame 40. The integrated lock 50 may be disposed on the first frame connection component 34 and/or the second frame connection component 44. The integrated lock 50 may be configured to be adjusted between a locked state and an unlocked state. Further, the integrated lock 50 may be set to the locked state based on the window system 1 being in the closed state described above.

Figure 5:
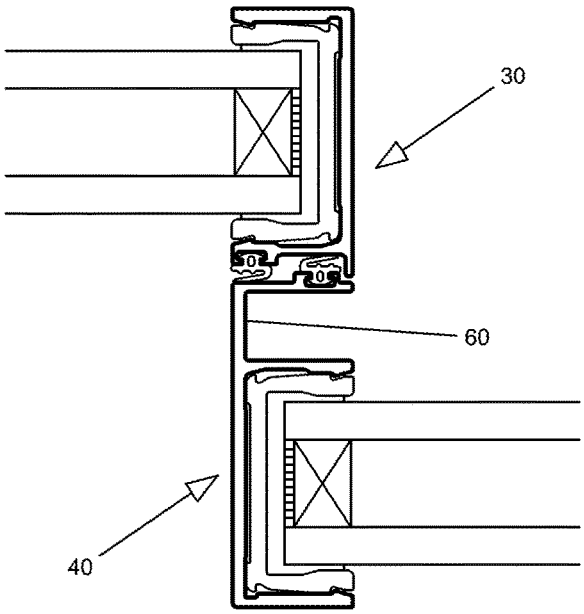
FIG. 5 is a diagram of a window system including an integrated handle according to an embodiment.

FIG. 5 is a diagram of a window system including an integrated handle according to an embodiment. As shown in FIG. 5, the window system 1 may include an integrated handle 60. As shown, the second frame 40 may include the integrated handle 60. In this case, the integrated handle 60 may perform a substantially similar function as the second frame connection component 44. Further, as shown in FIG. 5, the first frame 30 may not include the first frame connection component 34 as shown in FIG. 1.

Figure 6:
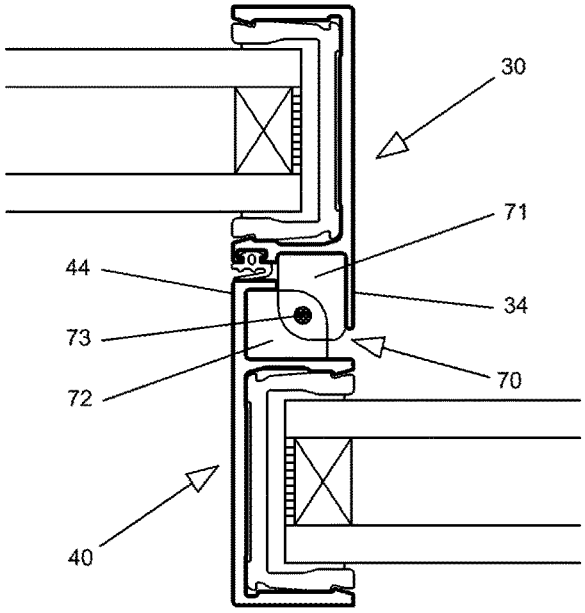
FIG. 6 is a diagram of a window system including an integrated hinge according to an embodiment.

FIG. 6 is a diagram of a window system including an integrated hinge according to an embodiment. As shown in FIG. 6, the window system 1 may include an integrated hinge 70, a first hinge component 71, a second hinge component 72, and a hinge point 73.

The first frame 30 may include the first hinge component 71. The first hinge component 71 may extend from the first frame connection component 34. The second frame 40 may include the second hinge component 72. The second hinge component 72 may extend from the second frame connection component 44. The first hinge component 71 and the second hinge component 72 may be connected via a hinge point 73. The hinge point 73 may be formed by a bolt, a pin, a lock, a bar, a strap, and/or the like. In this way, the second frame 40 may hinge with respect to the first frame 30.

Figure 7:
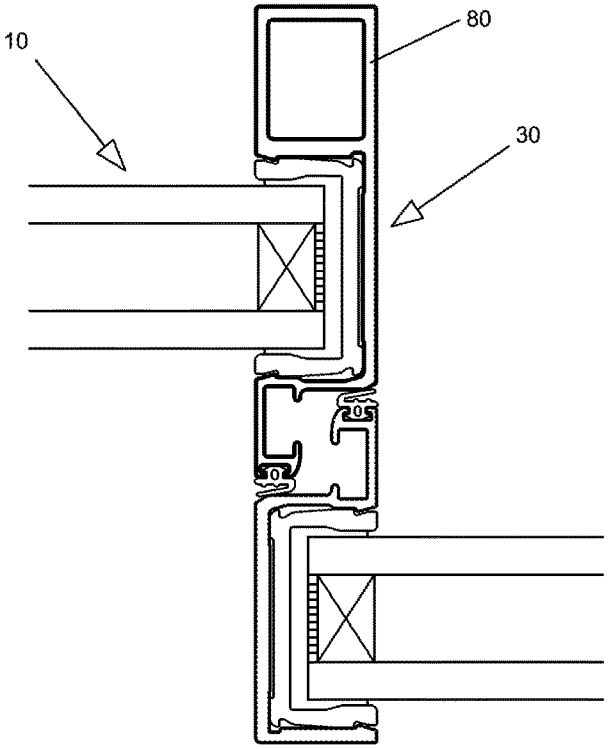
FIG. 7 is a diagram of a window system including a reinforced portion according to an embodiment.

FIG. 7 is a diagram of a window system including a reinforced portion according to an embodiment. For example, as shown, the first frame 30 may include a reinforced portion 80 that extends away from the first window 10 in the second direction. In this way, the strength of the window system 1 may be improved via the reinforced portion 80. However, in other embodiments, the second frame may include a reinforced section that extends away from the second window in the second direction or both the first frame and second frame may include reinforced portions that extend away from the first window and second window in the second direction.

Figure 8:
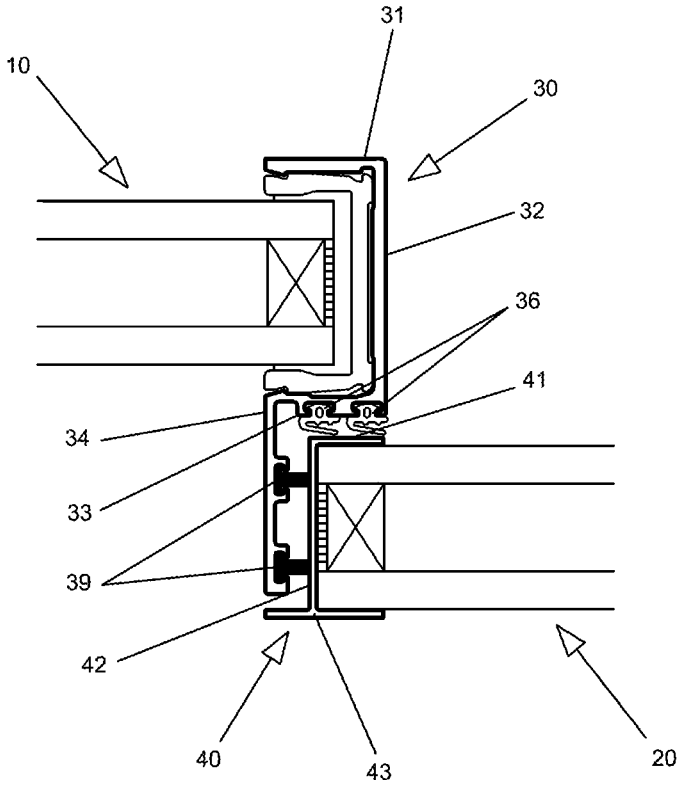
FIG. 8 is a diagram of a window system including an open sided portion according to an embodiment.

FIG. 8 is a diagram of a window system including an open sided portion according to an embodiment. As shown in FIG. 8, the window system 1 may include a first window 10, a second window 20, a first frame 30, and a second frame 40.

The first frame 30 may include a first internal frame surface 31, a first side frame surface 32, a first external frame surface 33, and a first frame connection component 34. Further, the first frame 30 may include a set of first connection mechanisms 36 that is configured to connect the first frame 30 to the second window 20. Further, the first frame 30 may include a set of water proofing mechanisms 39 that is configured to connect the first frame 30 to the second frame 40.

The second frame 40 may include a second side frame surface 42, and a second external frame surface 43. However, in contrast to the window system 1 of FIG. 1, the second frame 40 may not include the second frame connection component 44 that extends from the second internal frame surface 41.

In this way, the window system 1 shown in FIG. 8 may include an open sided portion, and may provide a further improved sightline by reducing a thickness of the window system 1 in the second direction.

Figure 9:
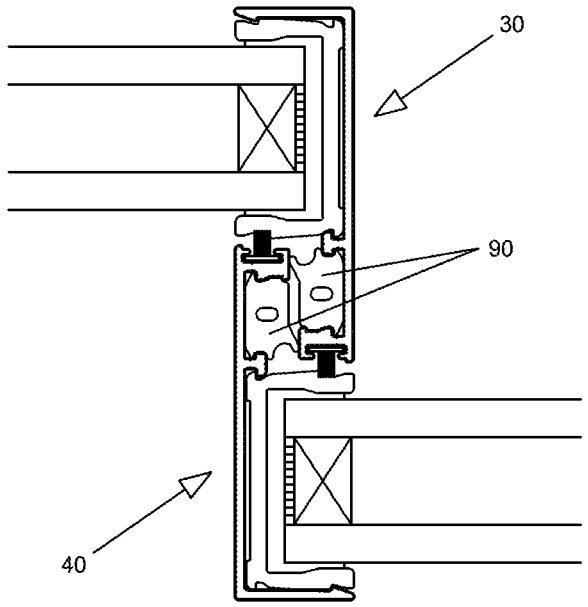
FIGS. 9 and 10 are diagrams of a window system including a thermal break according to an embodiment.
Figure 10:
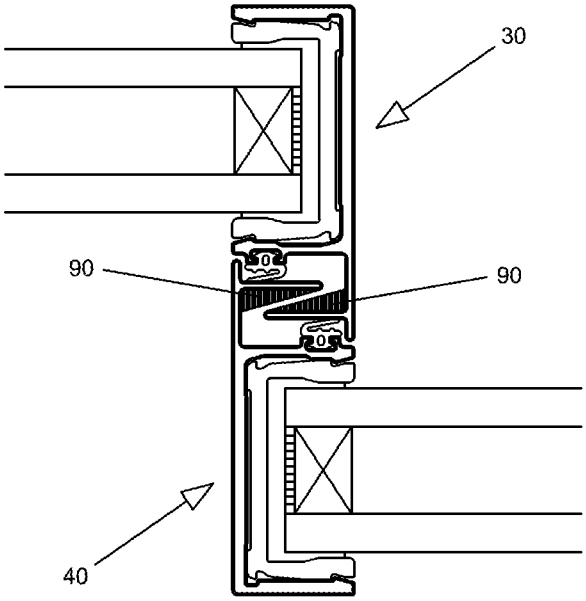

FIGS. 9 and 10 are diagrams of a window system that are thermally broken according to an embodiment. As shown in FIGS. 9 and 10, the window system 1 may include a thermal break connection 90. That is, the first frame 30 may include a thermal break connection 90, and the second frame 40 may include a thermal break connection 90. For example, the thermal break connection 90 may include a plastic, a rubber, a foam, and/or the like, that connects the first frame 30 and the second frame 40. Accordingly, in this way, the window system 1 may include improve thermal insulation properties.

The foregoing disclosure provides illustration and description, but is not intended to be exhaustive or to limit the implementations to the precise form disclosed. Modifications and variations are possible in light of the above disclosure or may be acquired from practice of the implementations.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A window system comprising:

a first window including:

a first internal window surface that extends in a first direction;

a first external window surface that extends in the first direction, and that is disposed behind the first internal window surface in a second direction that is orthogonal to the first direction; and a first side window surface that extends between the first internal window surface and the first external window surface in the second direction;

a second window including:

a second internal window surface that extends in the first direction, and that is disposed behind the first external window surface of the first window in the second direction;

a second external window surface that extends in the first direction, and that is disposed behind the second internal window surface in the second direction; and a second side window surface that extends between the second internal window surface and the second external window surface in the second direction;

a first frame, that is configured to support the first window, including:

a first internal frame surface that extends in the first direction, and that is configured to support the first internal window surface of the first window;

a first external frame surface that extends in the first direction, and that is configured to support the first external window surface of the first window;

a first side frame surface that extends between the first internal frame surface and the first external frame surface, and that is configured to support the first side window surface of the first window; and a first frame connection component that extends from the first external frame surface in the second direction towards a second internal frame surface of a second frame, and that is configured to connect to the second internal frame surface of the second frame;

the second frame, that is configured to support the second window, including:

the second internal frame surface that extends in the first direction, and that is configured to support the second internal window surface of the second window;

a second external frame surface that extends in the first direction, and that is configured to support the second external window surface of the second window;

a second side frame surface that extends between the second internal frame surface and the second external frame surface in the second direction, and that is configured to support the second side window surface of the second window; and a second frame connection component that extends from the second internal frame surface in the second direction towards the first external frame surface of the first frame, and that is configured to connect to the first external frame surface of the first frame, wherein the window system is configured to be arranged in only two states consisting of:

a closed state in which the window system is closed and the first window and the second window are parallel in the first direction, panes thereof partly overlap in a second direction that is orthogonal to the first direction, and are connected by the first frame connection component and the second frame connection component, and an opened state in which the window system is opened by a disconnection between the first window and the second window from the first frame connection component, the disconnection comprising the first window and the second window becoming non-parallel to each other.

2. The window system of claim 1, wherein:

the first frame connection component is configured to disconnect from the second internal frame surface of the second frame;

the second frame connection component is configured to disconnect from the first external frame surface of the first frame; and the second window is configured to move with respect to the first window in the first direction and the second direction between the closed state and the opened state based on the first frame connection component being disconnected from the second internal frame surface of the second frame and based on the second frame connection component being disconnected from the first external frame surface of the first frame.

3. A window system comprising:

a first window including:

a first internal window surface that extends in a first direction;

a first external window surface that extends in the first direction, and that is disposed behind the first internal window surface in a second direction that is orthogonal to the first direction; and a first side window surface that extends between the first internal window surface and the first external window surface in the second direction;

a second window including:

a second internal window surface that extends in the first direction, and that is disposed behind the first external window surface of the first window in the second direction;

a second external window surface that extends in the first direction, and that is disposed behind the second internal window surface in the second direction; and a second side window surface that extends between the second internal window surface and the second external window surface in the second direction;

a first frame, that is configured to support the first window, including:

a first internal frame surface that extends in the first direction, and that is configured to support the first internal window surface of the first window;

a first external frame surface that extends in the first direction, and that is configured to support the first external window surface of the first window;

a first side frame surface that extends between the first internal frame surface and the first external frame surface, and that is configured to support the first side window surface of the first window; and a first frame connection component that extends from the first external frame surface in the second direction towards the second window, and that is configured to connect to the second window;

a second frame, that is configured to support the second window, including:

a second external frame surface that extends in the first direction, and that is configured to support the second external window surface of the second window; and a second side frame surface that extends in the second direction, and that is configured to support the second side window surface of the second window, wherein the window system is configured to be arranged in only two states consisting of:

a closed state in which the window system is closed and the first window and the second window are parallel in the first direction, panes thereof partly overlap in a second direction that is orthogonal to the first direction, and are connected by the first frame connection component and a second frame connection component, and an opened state in which the window system is opened by a disconnection between the first window and the second window from the first frame connection component, the disconnection comprising the first window and the second window becoming non-parallel to each other.

* * * * *